US005370325A

United States Patent [19]

Borer

[11] Patent Number: 5,370,325

[45] Date of Patent: Dec. 6, 1994

[54] APPARATUS FOR THE WINDING OF A THREAD ONTO A REEL

[75] Inventor: Silvan Borer, Rüschlikon, Switzerland

[73] Assignee: Schaerer Schweiter Mettler A.G., Horgen, Switzerland

[21] Appl. No.: 983,098

[22] Filed: Nov. 27, 1992

Related U.S. Application Data

[63] Continuation of Ser. No. 710,028, Jun. 3, 1991, abandoned.

[30] Foreign Application Priority Data

Jun. 20, 1990 [CH] Switzerland ..... 2061/90-4

[51] Int. Cl.[5] ..... B65H 54/28

[52] U.S. Cl. ..... 242/43 R

[58] Field of Search ..... 242/43 R, 43.1, 158 B, 242/26.1, 26.2, 26.3

[56] References Cited

U.S. PATENT DOCUMENTS

| | | | |
|---|---|---|---|
| 766,878 | 8/1904 | Foster | 242/43 R X |
| 1,529,816 | 3/1925 | Stenglein | 242/43 R |
| 1,957,979 | 5/1934 | Richter | 242/43.1 |
| 2,388,557 | 11/1945 | Little et al. | 242/43 R |
| 2,659,539 | 11/1953 | Stenglein | 242/43 R |
| 2,848,173 | 8/1958 | Hebberling | 242/43 R |
| 3,204,885 | 9/1965 | Silfhout | 242/43 R |
| 3,347,475 | 10/1967 | Sternberg | 242/26.1 |
| 3,347,478 | 10/1967 | Sternberg | 242/26.3 |
| 4,003,510 | 1/1977 | Rebsamen et al. | 242/43 R X |
| 4,034,934 | 7/1977 | Hardwick | 242/158 B |

FOREIGN PATENT DOCUMENTS

| | | | |
|---|---|---|---|
| 0311784 | 4/1989 | European Pat. Off. | 242/43 R |
| 1461390 | 11/1966 | France . | |
| 94416 | 8/1969 | France . | |
| 2275398 | 1/1976 | France . | |
| 3417716 | 11/1985 | Germany | 242/43 R |
| 872955 | 7/1961 | United Kingdom . | |
| 1034451 | 6/1966 | United Kingdom . | |
| 1081622 | 8/1967 | United Kingdom . | |

*Primary Examiner*—Stanley N. Gilreath
*Attorney, Agent, or Firm*—EGLI International

[57] ABSTRACT

A process and apparatus for the winding of a thread onto a reel.

A thread is guided by a thread guide fastened to a cord. The cord is driven by a drive part, which, under the action of a transfer roller engaging in a slot, executes a harmonic oscillation. A transfer roller is attached to a disc-shaped bearing part, driven by means of a driving wheel, and can, for changing the amplitude of the harmonic oscillation, be displaced in the radial direction by utilizing an electric motor. For the purpose of approximating the thread guide movement to a triangular oscillation, a heart-shaped compensating disc, likewise driven by the driving wheel, sets a carriage in oscillating movement synchronous to the harmonic oscillation, so that, due to displaceable pairs of rollers, which are mounted on the carriage and via which the cord is led, as also via fixed rollers lying between successive displaceable rollers, in each case the path of the cord is lengthened on one side of the traversing interval and correspondingly shortened on the other side.

13 Claims, 3 Drawing Sheets

APPARATUS FOR THE WINDING OF A THREAD ONTO A REEL

This is a continuation application of Ser. No. 07/710,028, filed Jun. 3, 1991, now abandoned.

BACKGROUND OF THE INVENTION

1. Field of the Invention

The present invention relates to an apparatus for the winding of a thread onto a reel.

2. Discussion of the Prior Art

A general process for the winding of a thread onto a reel is discussed in European Patent No. EP 0 113 784 A1, in which the cord to which the thread guide is fastened is passed via fixed deflecting rollers, arranged on both sides of the traversing interval, and a drive roller, the direction of rotation of which must be reversed as abruptly as possible when the thread guide movement reaches a reversal point. This solution requires that the drive roller, which in the interests of continuity of the thread guide movement between the reversal points should have a relatively great moment of inertia, is subjected to a very high angular acceleration, which according to the cited document is achieved by transferring the kinetic energy of the drive roller and of the parts at least frictionally connected to it to rotationally suspended flywheel masses, which return the rotational energy imparted to them back to the drive roller once the thread guide has passed through the reversal point. Since the energy transfer from the drive roller to the respective flywheel mass begins with an acutely angled collision, which requires a precise adjustment of parts of relatively high mass subjected to high forces, it is to be feared that the long-term stability of the apparatus is precarious, even with considerable expenditure on the structural design.

SUMMARY OF THE INVENTION

The object of the invention is to provide an apparatus of the generic type in which, the movements in particular of parts of relatively high mass are as continuous as possible and do not require any high accelerations or angular accelerations.

The present invention is directed to, an apparatus having thread guide movement together with the required rapid reversal at the reversal points is produced by superimposing simple movement sequences which can be derived from smooth rotational movements.

Further, the apparatus has smoothly rotating parts which drive oscillating parts, the messes of which can be kept small and the displacements of which are, in part, greatly shortened by additional measures, which also correspondingly reduces the accelerations to which they are subjected.

This results in general in continuous movement sequences, in which virtually only the thread guide and the cord driving it—both parts of low mass—are subjected to the high accelerations unavoidable here, whereas more complicated mechanical parts also of higher mass are in all cases subjected to only relatively low accelerations. As a result, a high life time of the apparatus and low requirements of the same with respect to servicing, in particular readjustment, are achieved without great expenditure on structural design.

BRIEF DESCRIPTION OF THE DRAWINGS

The invention is explained below with reference to drawings just representing ways of carrying it out, in which.

DESCRIPTION OF THE PREFERRED EMBODIMENTS

Figure 1A:
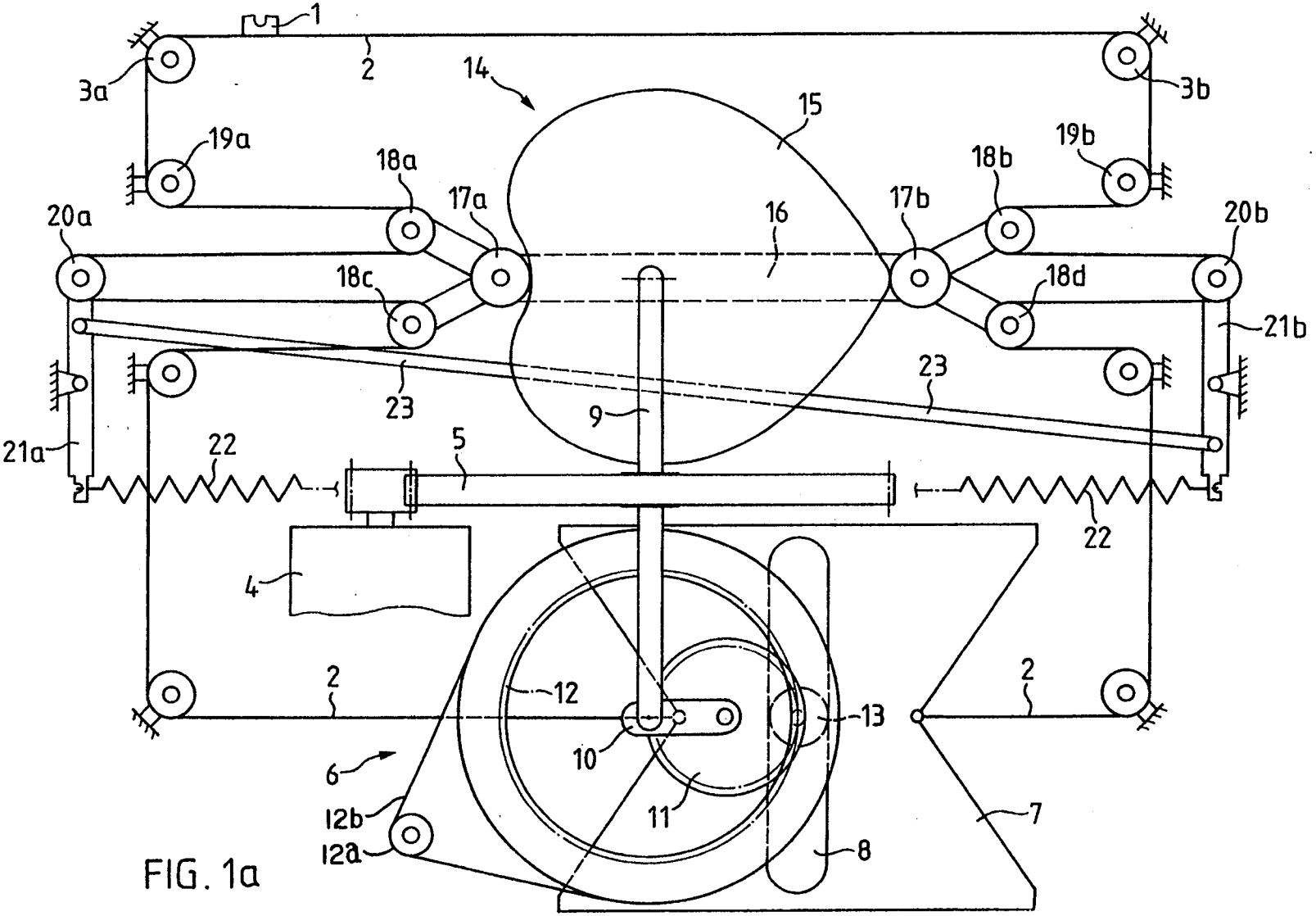
FIG. 1*a* shows in diagrammatic representation a first embodiment of an apparatus according to the invention

The apparatus represented in FIG. 1*a* has a thread guide 1, which is fastened to a cord 2, which runs via rollers 3*a*, 3*b*, which laterally bound the traversing interval over which the position of the thread guide 1 can vary. A motor 4 drives via a driving wheel 5 a drive apparatus 6, which for better understanding of its function is shown swung into the plane of the Figure in relation to its actual position with respect to the driving wheel 5.

According to the invention, the drive apparatus 6 has a displaceable drive part 7, to which the ends of the cord 2 are fastened and which is provided with a slot 8, aligned perpendicularly to the direction of movement of the said drive part. Rigidly connected to the driving wheel 5 by a shaft 9 is an arm 10, which bears a gear wheel 11, which is in engagement with a gear rim 12. The diameter of the gear wheel 11 is half the diameter of the gear rim 12. It bears in the region of its periphery a transfer roller 13, which protrudes in the axial direction and engages in the slot 8 of the drive part 7. Normally, gear rim 12 is kept in a fixed position during the winding operation; however, the gear rim 12 is rotatable about its axis, which coincides with the center line of the shaft 9, by means of a motor (not shown) or by hand rotation. The gear rim is connected to a pulley 12*a* by means of a belt 12*b*. The motor rotates or drives the pulley 12*a*, which by means of the belt 12*b* causes rotation of the gear rim 12.

Likewise shown as swung into the plane of the Figure for better understanding is a compensating apparatus 14, having an approximately heart-shaped compensating disc 15, the centre point of which is rigidly connected via the shaft 9 to the driving wheel 5 and the arm 10 and the diameter of which through the centre point is angle-independent in the sense that the diameter of the disc 15 remains the same regardless of the position of the disc 15, thereby ensuring a constant contact between the disc 15 and the rollers 17*a* and 17*b*. A carriage 16 contacts the compensating disc 15 by means of contact rollers 17*a*, 17*b* at mutually diametrically opposite points of the periphery of the said disc. It is mounted displaceably along the line adjoining said contact points and bears at each end a pair of rollers, referred to hereinafter as displaceable rollers 18*a*, 18*b*, 18*c*, 18*d*.

To the left of the traversing interval, after the roller 3*a*, the cord 2 runs via a deflecting roller 19*a*, then via the first displaceable roller 18*a*, a fixed, i.e. not fastened to the carriage 16 but connected to the housing, roller 20*a*, on via the second displaceable roller 18*c* and via further deflecting rollers to the drive part 7. To the right of the traversing interval, the relative arrangements are analogous.

The fixed rollers 20*a*, 20*b* are not fastened directly to the housing but in each case to a pivotally suspended lever 21*a*, 21*b*, which on one side of the pivot point bears the roller, whereas on the other side there acts a spring 22, which is stretched between the two levers 21*a*, 21*b*. The levers are also connected by a rod 23, which is pivotally anchored to the lever 21*a* on the side of the pivot point which bears the roller 20*a* and in the case of the lever 21*b* on the side which is opposite the roller 20*b*, to be precise at the same distance from the pivot point as on the lever 21*a*.

The apparatus described functions as follows:

The arm 10 is set in a smoothly rotating movement by the motor 4, via the driving wheel 5 and the shaft 9. The gear wheel 12 normally stays at rest during operation. Owing to the rotation of the arm 10, the gear wheel 11 in engagement with the gear rim 12 also rotates, to be precise—as known from kinematics—in such a way that the transfer roller 13 fastened at its periphery executes a harmonic oscillation, sweeping over a diameter of the gear rim 12, the component of this oscillation which is parallel to the direction of movement of the drive part 7 being transferred by the engagement of the transfer roller 13 in the slot 8 to the drive part 7 and consequently to the cord 2. The angular position of the diameter swept over by the transfer roller 13 can be varied by also turning the gear rim 12 during the winding operation. The rotation of the gear rim 12 as described above is slow compared to the rotation of the arm and should not exceed 90 degrees as explained above. The gear rim 12 can be mounted, for example, on a wheel which is rotatable about an axis coinciding with the center line of the shaft 9. In the position represented in FIG. 1*a*, the diameter swept over lies parallel to the direction of movement of the drive part 7, which corresponds to a maximum amplitude of the harmonic oscillation transferred to the same. If said diameter includes a certain angle with said direction of movement, the amplitude of the oscillation of the drive part 7 corresponds to the maximum amplitude multiplied by the cosine of this angle. If the angle reaches 90°, the amplitude accordingly drops to zero, the movement of the transfer roller 13 runs parallel to the slot 8 and normal to the direction of movement of the drive part 7.

Basically, changing the position of the gear rim 12 by rotation causes a rotation of the gear wheel 11 in the same direction. As the gear wheel rotates, the transfer roller 13 changes position as previously described; accordingly, when the gear rim 12 is rotated, the position of the transfer roller 13 changes as well. Normally, the motion of the transfer roller 13 is a superposition of the motions of the center of the gear wheel 11 and the gear wheel's 11 rotation. In rotating the gear rim 12 a given angle, the phase relationship between the gear wheel 11 and the transfer roller 13 is changed thereby leading to a rotation of the line along which the transfer roller 13 rotates by the same angle.

Figure 2:
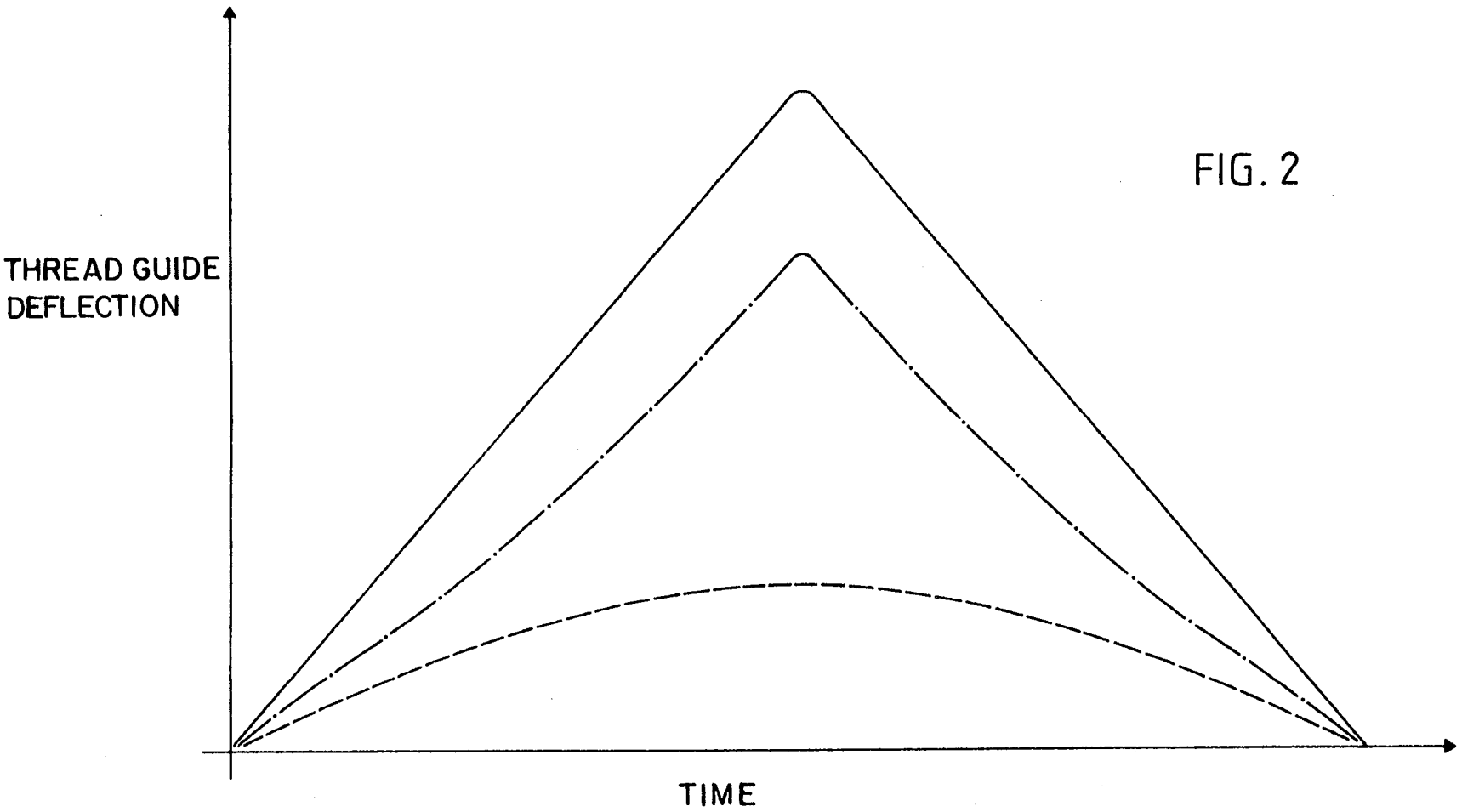
FIG. 2 shows the deflection of the thread guide as a function of time according to the invention as well as its split into a fundamental component and a complementary component.

FIG. 2 shows one half-cycle of thread guide motion, that is, its motion from the middle of the deflection interval to one of the reversal points and back.

At a certain mean amplitude, the movement of the thread guide 1 would proceed as represented in the dashed curve in FIG. 2 if it were induced exclusively by the harmonic oscillation of the drive part 7. However, such a harmonic oscillation of the thread guide 1 is not desired, rather it is to execute a movement corresponding to the solid line in FIG. 2, i.e. an oscillation movement which comes as close as possible to being represented by a triangular curve which hereinafter will be referred to as a triangular, oscillation, at constant speed between two reversal points with instantaneous reversal of direction at the same. This approximation to a triangular oscillation is achieved by means of the compensating apparatus 14.

The compensating disc 15 is rigidly connected via the shaft 9 to the driving wheel 5 and rotates synchronously with the latter and the arm 10. As a result, the carriage 16 is set in an oscillating movement which is synchronous with the harmonic movement of the drive part 7 and which—in the phase represented in FIG. l*a*—due to the corresponding movement of the displaceable rollers 18*a*, 18*c* and 18*b*, 18*d*, effects a lengthening of the path of the cord 2 between the roller 3*a* and the drive part 7 or a corresponding shortening between the roller 3*b* and the same. If the compensating disc 15 is turned through 180°, lengthening and shortening of the path of the cord 2 are interchanged. Due to the block-and-tackle-like constructions, in which the cord 2 is in each case directed between two displaceable rollers 18*a*, 18*c* and 18*b*, 18*d* via a fixed roller 20*a* and 20*b*, respectively, this shortening or lengthening is increased to four times the deflection of the carriage 16. Of course, higher factors can be achieved by higher numbers of displaceable and fixed rollers. As far as the movement of the thread guide 1 is concerned, the harmonic movement effected by the oscillation of the drive part 7 is superimposed by the complementary movement caused by the compensating apparatus 14, which movement is represented by dot-dashed lines in FIG. 2.

They add together to give the desired oscillation, coming very close to the triangular curve.

Due to the sprung suspension of the fixed rollers 20*a*, 20*b*, temporary elastic and fatigue extensions of the cord 2 are taken up and the latter is kept taut at all times. In this arrangement, the rod 23 prevents the rollers moving asymmetrically with respect to one another and falsifying the thread guide movement.

In the case of the apparatus described, the oscillating movement of the thread guide 1 is derived exclusively from smooth rotational movements. Thus, if at all, the rotating parts are subject to slight accelerations exerted on them by the actions of oscillating parts. They can be made to be of any mass and do not limit the speed at which the apparatus can be operated, in particular if the mass distribution of the compensating disc 15 is chosen such that the axis of rotation coincides with a principal axis. The drive part 7 executes a harmonic oscillation and is therefore likewise not subjected to any very high mechanical loads. Apart from the thread guide 1 and parts of the cord 2, where they are in principle unavoidable, only the carriage 16, with the rollers fastened on it, is subjected to high accelerations. However, even these are greatly reduced, since the deflection of the carriage 16 can be kept small thanks to the block-and-tackle-like construction, by means of which the movement of the carriage 16 is transferred to the cord 2.

Figure 1B:
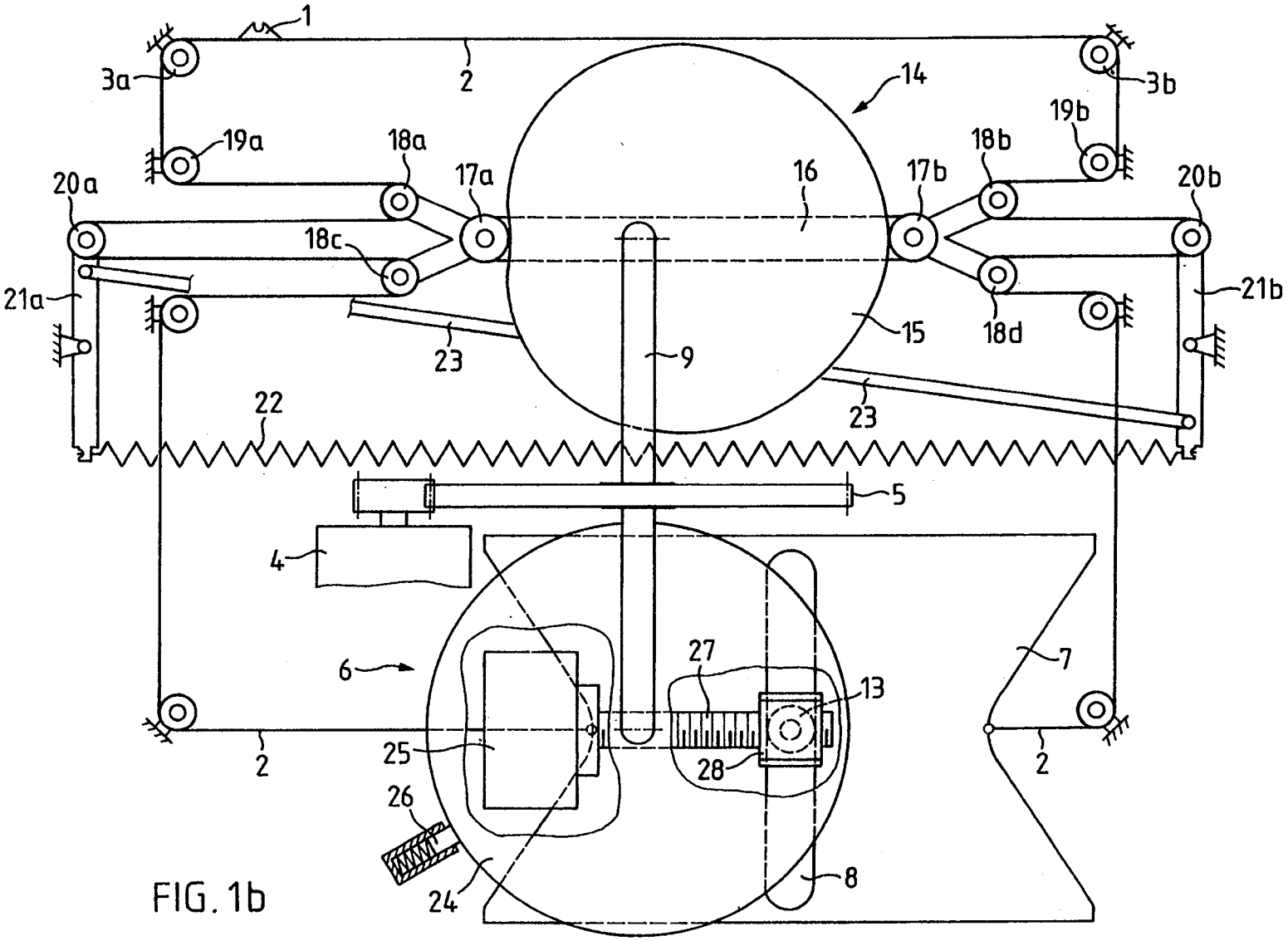
FIG. 1*b* shows in diagrammatic representation a second embodiment

Of course it is not necessary for the fundamental oscillation executed by the drive part 7 and transferred to the cord 2 to be an exactly harmonic oscillation. Rather, what is decisive is that no extreme accelerations occur—even at the reversal points. Harmonic oscillations have the advantage, however, that they can be derived from rotational movements by particularly simple means. A further example of this is described below in conjunction with FIG. 1*b*.

The compensating disc 15 is connected here via the shaft 9 not only to the driving wheel 5 but also to a disc-shaped bearing part 24, which bears an electric motor 25, which can be supplied with current via a sliding contact 26. The electric motor 25 serves to drive a spindle 27, by means of which the transfer roller 13, which is fastened on a carriage 28 displaceable along a radius of the bearing part 24, can be displaced. Otherwise, the apparatus corresponds to that described in conjunction with FIG. 1*a*.

By means of the electric motor 25, the amplitude of the harmonic oscillation executed by the drive part 7 can be adjusted even during the winding operation. In contrast to the design according to FIG. 1*a*, in this case no phase shifts occur between the harmonic oscillation and the complementary movement caused by the compensating apparatus 14.

In the case of both designs described, the amplitude with which the carriage 16 is oscillated is invariable. Therefore, an exact addition of the harmonic oscillation and the complementary oscillation components induced by the compensating apparatus to form a triangular oscillation is possible only at a certain amplitude of the harmonic oscillation. If the chosen amplitude deviates from this, deviations from the ideal form of oscillation also occur.

What is claimed is:

1. Apparatus for winding a thread onto a reel, comprising:

a thread guide for guiding thread onto a reel, the thread guide being fastened to a cord between first and second interval defining members so as to define a traversing interval such that the thread guide is movable over the traversing interval with an approximate triangular oscillation;

a drive member connected to said cord for generating approximate harmonic motion of the cord; and a displaceable carriage member operatively associated with the cord for generating oscillatory motion of the cord such that the oscillatory motion and the harmonic motion of the cord are superimposed to form the approximate triangular motion of the thread guide.

2. Apparatus according to claim 1 wherein the displaceable carriage member includes a carriage and at least one pair of displaceable rollers.

3. Apparatus according to claim 2, further comprising a rotatable compensating disc in contact with said displaceable carriage for providing smooth oscillatory motion thereof.

4. Apparatus according to claim 3, wherein the compensating disc is designed as an approximately heart-shaped disc, the diameter of which through the centre point is essentially angle-independent.

5. Apparatus according to claim 3 wherein the carriage has two contact rollers for the contacting of the compensating disc.

6. Apparatus according to claim 2 wherein the at least one pair of displaceable rollers is firmly mounted on the carriage.

7. Apparatus according to claim 2 wherein the displaceable carriage member comprises two pairs of displaceable rollers disposed between the carriage and the cord such that the cord is led between each pair of the two pairs of displaceable rollers via at least one fixed roller.

8. Apparatus according to claim 7, further comprising a fixed roller on each side of the traversing interval and attached to a mounting, the cord being led on each of both sides of the traversing interval via the fixed rollers, and prestressed spring means acting on the two pairs of dispaceable rollers for keeping the cord taut.

9. Apparatus according to claim 8, wherein each mounting includes a pivotally suspended lever having one of the fixed rollers on one side of the pivot point of the lever and the prestressed spring means is stretched between each lever and acts on the other side of the pivot point, and a rod pivotally anchored to one of the levers on the side of the pivot point bearing the fixed roller and to the other lever on the opposite the fixed roller so as to prevent asymmetric movement between the fixed rollers.

10. Apparatus according to claim 2 and further comprising means for producing a fundamental oscillation of the drive member, said means comprising a gear rim, an arm rotatable about the center of said gear rim and carrying a rotatably mounted gear wheel having half the diameter of a gear rim and engaging the same, said gear wheel carrying close to its periphery a transfer member that protrudes in an axial direction so to engage in a slot in the drive part that runs transversely to its direction of movement.

11. Apparatus according to claim 10, wherein the gear rim is rotatably fastened so as to permit amplitude control of the fundamental oscillation.

12. Apparatus according to claim 10, wherein the arm and the compensating disc are connected via a common shaft this is driven by the drive apparatus.

13. Apparatus according to claim 10, wherein the transfer member is designed as a transfer roller.

* * * * *